United States Patent [19]

Rogers et al.

[11] Patent Number: 4,969,981

[45] Date of Patent: Nov. 13, 1990

[54] CELL AND METHOD OF OPERATING A LIQUID-GAS ELECTROCHEMICAL CELL

[75] Inventors: Derek J. Rogers; Robert D. Klassen, both of Kingston; Allan James, Wallaceburg; Indresh Mathur, Sarnia; Edward B. Noonan, Kingston, all of Canada

[73] Assignee: H-D Tech Incorporated, Woodbridge, Canada

[21] Appl. No.: 398,610

[22] Filed: Aug. 25, 1989

Related U.S. Application Data

[63] Continuation-in-part of Ser. No. 246,226, Sep. 19, 1988, abandoned.

[51] Int. Cl.[5] ..... C25B 1/26; C25B 1/30; C25B 1/34; C25B 9/00

[52] U.S. Cl. ..... 204/84; 204/98; 204/128; 204/255; 204/256; 204/257; 204/258; 204/263; 204/265

[58] Field of Search ..... 204/84, 98, 128, 252–258, 204/283, 263–266

[56] References Cited

U.S. PATENT DOCUMENTS

| | | | |
|---|---|---|---|
| 3,969,201 | 7/1976 | Oloman et al. | 204/83 |
| 4,250,002 | 2/1981 | Lazarz et al. | 204/296 X |
| 4,445,986 | 5/1984 | McIntyre et al. | 204/98 |
| 4,457,953 | 7/1987 | McIntyre et al. | 427/113 |
| 4,498,961 | 2/1985 | Lazarz et al. | 204/296 X |
| 4,511,441 | 4/1985 | McIntyre et al. | 204/98 |
| 4,547,411 | 10/1985 | Bachot et al. | 204/296 X |
| 4,758,317 | 7/1988 | Chiang | 204/283 X |
| 4,872,957 | 10/1989 | Dong et al. | 204/252 X |
| 4,891,107 | 1/1990 | Dong et al. | 204/252 X |

*Primary Examiner*—Donald R. Valentine
*Attorney, Agent, or Firm*—Andrew E. Pierce

[57] ABSTRACT

An electrochemical cell having improved current efficiency and a method for electrochemically reacting a liquid electrolyte with a gas in an electrochemical cell. The cell has at least two electrodes separated by a cell separator wherein at least one of said electrodes is a porous, self-draining, gas diffusion electrode. In one embodiment of the invention, an electrolyte is flowed through said cell separator into a porous, self-draining electrode and simultaneously the electrode is fed with a mixture of a reactive gas and water or an electrolyte. In another embodiment of the invention in which the cell separator is an ion exchange permselective membrane, a mixture of a reactive gas and an electrolyte are fed to the porous, self-draining electrode. Preferably said porous, self-draining electrode is a cathode.

21 Claims, 1 Drawing Sheet

CELL AND METHOD OF OPERATING A LIQUID-GAS ELECTROCHEMICAL CELL

This is a continuation-in-part of copending application Ser. No. 07/246,226 filed on Sept. 19, 1988, now abandoned.

BACKGROUND OF THE INVENTION

1. Field of the Invention

This invention relates to electrochemical cells for reacting a liquid electrolyte with a gas, each ell unit having a porous, self-draining electrode.

2. Description of the Prior Art

Packed bed electrolytic cells are known for Oloman et al U.S. Pat. No. 3,969,201 and U.S. Pat. No. 4,118,305. Improvements in these cells have been disclosed by McIntyre et al in U.S. Pat. No. 4,406,758; U.S. Pat. No. 4,431,494; U.S. Pat. No. 4,445,986; U.S. Pat. No. 4,511,441; and U.S. Pat. No. 4,457,953. These packed bed electrolytic cells are particularly useful for the production of alkaline solutions of hydrogen peroxide.

Among known bleaching agents, hydrogen peroxide is at the present time being increasingly used, in particular for bleaching or brightening materials such as textiles or paper pulp. Hydrogen peroxide has the great advantage over other bleaching agents, in particular chlorine and its compounds, in that because of its mild action, it attacks the fibers of the material to be treated to a much lesser extent and gives a better finish.

Hydrogen peroxide is generally used in bleaching in the form of a stabilized alkaline solution of low peroxide concentration, the weight ratio of alkali, i.e., NaOH to hydrogen peroxide ($H_2O_2$) generally being about 0.5 to about 2.0. The action of hydrogen peroxide in bleaching consists essentially of destroying or decolourising the natural dyes by oxidation, or by rendering them soluble. Even though the mechanism of these reactions has been little studied, it is generally assumed that the perhydroxyl ion, $HOO^-$ is responsible for the bleaching.

Present-day bleaching solutions based on hydrogen peroxide have the great disadvantage with respect to other conventional bleaching solutions (in particular hypochlorite-based solutions) of being relatively costly. Their widespread use is very dependent upon economic considerations, particularly when large quantities of low-value material such as paper pulp are to be treated. Present-day bleaching solutions are nearly always prepared by simple dissolving and dilution, starting from commercially available chemicals. Commercially available hydrogen peroxide is a particularly costly substance, as it is manufactured only in a small number of large industrial plants, and it has therefore to be highly concentrated for storage and transport purposes before being distributed. At the present time there is a need to replace the highly concentrated, commercially available hydrogen peroxide by on site manufacturing methods which enable dilute solutions of hydrogen peroxide to be produced directly, in order to reduce bleaching costs. However, up to the present time no economically satisfactory method has appeared.

Hydrogen peroxide is used not only for bleaching purposes, but also in an increasing number of other processes, in particular in the pollution control field. However, treatment solutions used for this purpose are likewise almost always prepared from highly concentrated hydrogen peroxide with the same disadvantages as heretofore stated.

In Grangaard, U.S. Pat. No. 3,607,687; U.S. Pat. No. 3,462,351; U.S. 3,507,769; and U.S. Pat. No. 3,592,749 there are disclosed electrolytic cells for the production of hydrogen peroxide in which the peroxide is produced in the cathode compartment of the cell which contains a cathode depolarized utilizing an oxygen containing gas. The electrochemical cells of Oloman et al and McIntyre et al disclosed in the patents cited above, are improvements over the cells of Grangaard partly as the result of the use of the novel electrode material disclosed in U.S. Pat. No. 4,457,953 in which there is disclosed a method for the production of coated particles for use in a packed bed electrode electrochemical cell.

SUMMARY OF THE INVENTION

The electrochemical cell of the invention and a method of operating said cell are particularly suited for the production of an aqueous alkaline hydrogen peroxide. In said cell there is used a porous, self-draining, gas diffusion electrode. In one embodiment, the cell is arranged so that the gas diffusion electrode and the opposing electrode are separated by a single or multiple layered cell separator or diaphragm which generally can be a liquid permeable separator or an ion exchange permselective membrane separator. Preferably, such diaphragms comprise a plurality of layers of a microporous polymer film. Most preferably, the diaphragm comprises a composite having multiple or variable layers of a composite comprising a microporous polyolefin film and a support fabric in order to provide substantially uniform electrolyte flow through said diaphragm into said porous, self-draining electrode. The electrochemical cell and process for operating said cell provide increased current efficiency by simultaneously flowing into said porous, gas diffusion electrode (1) said electrolyte through said cell diaphragm and (2) a reactive gas together with an aqueous liquid. Preferably said porous, gas diffusion electrode is a cathode.

DETAILED DESCRIPTION OF THE INVENTION AND THE PREFERRED EMBODIMENTS

It has been found, as disclose in U.S. patent applications Ser. No. 870,474, filed June 4, 1986, now U.S. Pat. No. 4,927,509 and Ser. No. 777,483, filed Sept. 19, 1985, now U.S. Pat. No. 4,891,109, both incorporated herein by reference, that a packed bed, self-draining cathode for maximum productivity within an electrochemical cell for the production of an alkaline hydrogen peroxide solution must be supplied with a liquid anolyte through an electrolyte porous diaphragm at a substantially uniform rate of flow across the porous diaphragm without appreciable variation of the flow rate as a function of the head of the electrolyte. In both these applications the flow rate is controlled using a cell diaphragm having plural layers.

Porous cell separators for packed bed electrolytic cells, as disclosed in the above cited McIntyre et al patents have permitted a considerable variation in flow rate with the flow rate at the base of the cell (exposed to the full head of the electrolyte) being appreciably faster than the flow rate in the center of the cell or at the top of the cell, where decreased head pressure is exerted on the diaphragm. This variation in flow rate has resulted in inefficiency of the cell. Reducing the overall flow rate through such cell diaphragms results in too little liquid electrolyte passing through the porous diaphragm into the cathode where the diaphragm is exposed to a minimal head of electrolyte. A reduced amount of electrolyte passing through the porous diaphragm into the cathode also results in an increase in cell voltage. An excessive amount of liquid electrolyte passing through the porous diaphragm causes flooding of the packed bed cathode and consequent reduction in the depolarizing effect of the oxygen containing gas fed to the packed bed cathode.

The cell of the instant invention when used to produce an aqueous alkaline hydrogen peroxide provides increased current efficiency and a lower ratio of NaOH to $H_2O_2$ as products of electrolysis produced at the cathode of the cell. Both of these improvements result in a lower cost product as the result of lower power consumption and lower caustic use. An unexpected advantage of the cell of the invention is the use of an aqueous liquid added to the cathode of the cell to provide a means of compensation for the uneven flow of electrolyte through the cell diaphragm when only a single layer cell diaphragm is used. Thus the starvation of the porous cathode at the portion exposed to little or no electrolyte head can be overcome by the addition of water or other aqueous liquid in mixture with the reactive gas which is fed to the cathode.

Figure 1:
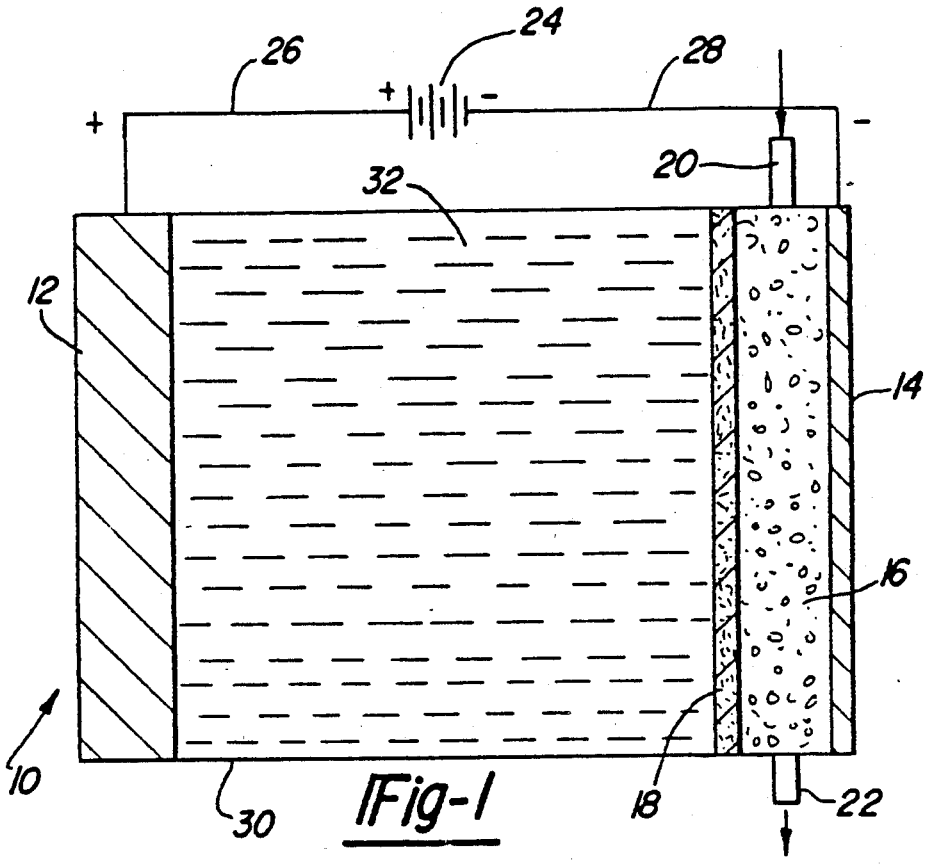
FIG. 1 is a diagramatic drawing of one embodiment of the invention showing an apparatus for producing alkaline hydrogen peroxide utilizing a monopolar electrolytic cell having an anolyte, a microporous polyolefin diaphragm, and a porous and self-draining, packed bed electrode.

In one embodiment of the invention illustrated in FIG. 1, there is diagrammatically shown an apparatus 30 for producing aqueous, alkaline hydrogen peroxide by electrolyzing a sodium hydroxide solution. The apparatus generally includes a cell container 10, an anode 12, a porous, self-draining cathode 16, a multiple layered, microporous polyolefin film diaphragm 18, and a current distributor 14. The current distributor 14 is located on a side of the cathode 16 which is opposite to that side of the cathode which contacts the diaphragm. An inlet 20 is provided for the addition of an oxygen containing gas together with an aqueous liquid as well as an outlet 22 through which spent oxygen containing gas and an aqueous alkaline solution of hydrogen peroxide are obtained. The spent oxygen containing gas, subsequent to concentration can be recycled through inlet 20. The apparatus is supplied with an external power supply 24 which is connected through lines 26 and 28 respectively to anode 12 and current distributor 14 for causing the oxygen containing gas which is introduced through inlet 20 to be reduced within the porous packed bed cathode 16 to produce $OH^-$and $O_2H^-$ions as the alkaline electrolyte 32 flows (in bulk) through diaphragm 18 into the packed bed cathode 16.

Figure 2:
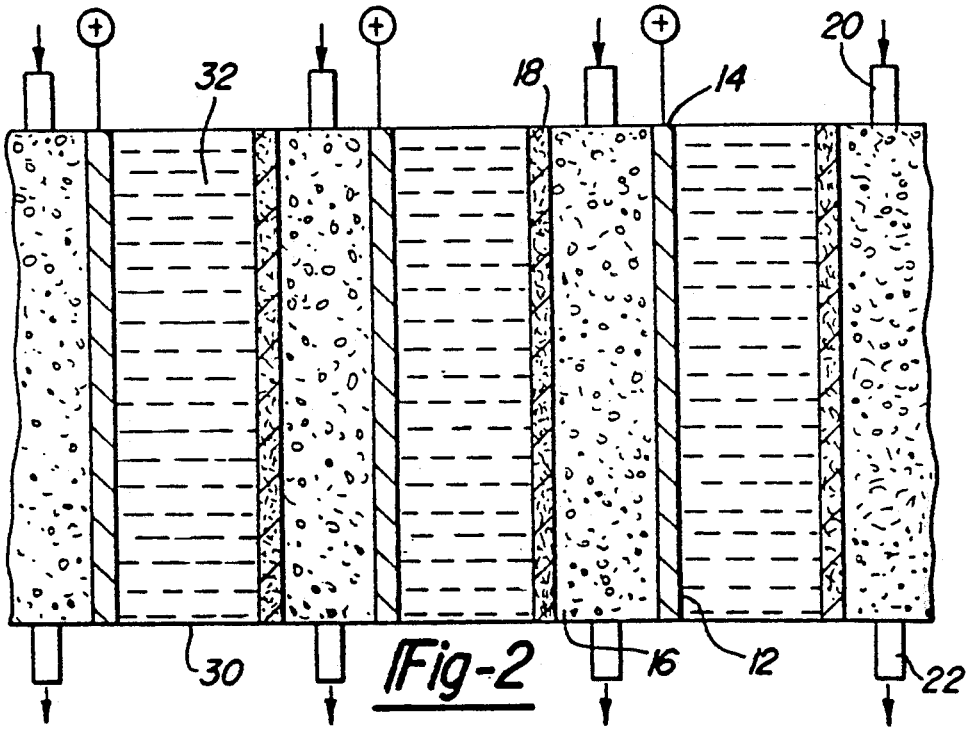
FIG. 2 is a diagramatic drawing of another embodiment of the invention showing an apparatus for producing hydrogen peroxide utilizing a bipolar electrolytic cell.

In FIG. 2, there is diagrammatically shown a portion of a cell apparatus 30 for producing hydrogen peroxide utilizing a bipolar electrolytic cell having an anode compartment containing an aqueous, alkaline anolyte 32, a porous, self-draining cathode 16, a current distributor 14 and a multiple layered, microporous polyolefin film diaphragm 18 which permits bulk flow of the aqueous, alkaline anolyte into the porous, packed bed cathode 16. The current distributor 14 is located on a side of the cathode 16 which is opposite to that side of the cathode which contacts the diaphragm. Each cell unit contains an inlet 20 for feeding an oxygen containing gas in admixture with an aqueous liquid into the porous packed bed cathode 16 and an outlet 22 for withdrawing spent oxygen containing gas and an aqueous, alkaline hydrogen peroxide which is the product of electrolysis at the cathode.

In another embodiment, not shown, an ion exchange permselective membrane cell separator is substituted for the microporous polyolefin film diaphragm 16. In this embodiment, it is necessary that the cathode 18 be simultaneously fed with an aqueous electrolyte and a reactive gas, such as an oxygen containing gas. In operation, in both bipolar and monopolar electrolytic cell embodiments of the cell apparatus of the invention for producing aqueous, alkaline, hydrogen peroxide, the aqueous, alkaline anolyte passes in bulk flow through the multiple layers of the diaphragm into the porous, self-draining cathode. The liquid electrolyte flow across the liquid permeable diaphragm is relatively uniform as the result of the use of multiple layers of the diaphragm material. The porous, self-draining cathode 16 is electrically conductive and is in contact with a current distributor and contacts, on the opposite face, the liquid permeable diaphragm 18. During operation, the cathode is fed with an oxygen containing gas in admixture with and an aqueous liquid. The aqueous, alkaline, hydrogen peroxide product of electrolysis is removed through outlet 22 at the base of the porous, self-draining cathode 16.

By feeding an oxygen containing gas in admixture with an aqueous liquid such as water or an aqueous electrolyte solution of an acid or base or salt thereof, i.e., sodium hydroxide, sodium sulfate, or sulfuric acid to the porous, self-draining cathode, there occurs, unexpectedly, increased current efficiency and a reduction in the ratio of sodium hydroxide to hydrogen peroxide in the product of electrolysis produced at the cathode.

Alternatively, the cell design shown in FIG. 1 and FIG. 2 can be adapted to the electrolysis of an alkali metal halide to produce a halogen, i.e., chlorine and an alkali metal hydroxide solution i.e., caustic. Such a cell provides increased current efficiency as compared to prior art electrolytic cells and also a higher concentration of alkali metal hydroxide as a product of electrolysis. When an electrolytic cell designed in accordance with the invention is utilized for the production of chlorine and an alkali metal hydroxide, an aqueous solution of an alkali metal halide is utilized as anolyte, halogen is produced at the anode or at the positively charged surface of the bipolar electrode. Hydrogen, which would normally be produced at the cathode or at the negatively charged surface of the bipolar cathode current distributor is not produced when an oxygen containing depolarizing gas in admixture with an aqueous liquid is fed to the porous, self-draining cathode, thus effecting a saving in cell voltage.

In another embodiment, the cell design can provide for vertically stacked individual units of the bipolar electrolytic cell by the use of frame components which can accommodate multiple cells stacked vertically thus forming an integral unit. This cell design is suited for use with a single layer cell diaphragm. The same units can also be stacked in the usual horizontal direction characteristic of prior art filter press type bipolar electrochemical cells. In the production of chlorine and caustic or in the production of an alkaline, aqueous solution of hydrogen peroxide by electrolysis, a porous, self-draining cathode is supplied with an oxygen containing gas together with an aqueous liquid. The diaphragm for use in the production of an alkali metal hydroxide and a halogen or an aqueous, alkaline hydrogen peroxide generally comprises a single layer or a plurality of layers of a microporous polymer film. Preferably, the diaphragm comprises a single layer or multiple or variable layers of (1) a microporous polyolefin film or (2) multiple or variable layers of said polyolefin film laminated to a support fabric resistant to degradation upon exposure to electrolyte.

In the following description, an electrochemical reaction for the production of an alkaline hydrogen peroxide solution is described as a representative electrochemical process utilizing a bipolar electrolyzer embodiment of the invention. The process is conducted by electrolyzing an aqueous solution comprising an alkali metal hydroxide as a liquid electrolyte. The electrolytic cell has an anolyte compartment, a single or a multiple layered, liquid permeable cell separator, a porous, packed bed cathode and a current distributor. The cell separator and current distributor are in contact with opposite faces of the porous, packed bed cathode. The face of the current distributor which is opposite to that which is in contact with the cathode is positively charged and the face of the porous, packed bed cathode which is in contact with the current distributor is negatively charged; the electrode assembly comprising the porous, packed bed cathode and the current distributor making up the bipolar electrode of the cell. An aqueous solution of hydrogen peroxide and an alkali metal hydroxide is recovered as the product of electrolysis from the lower part of the bipolar electrode. An oxygen containing gas, such as air, is flowed in admixture with water or an aqueous electrolyte into at least a portion of the porous, self-draining cathode. Electrolyte is simultaneously controllably flowed from the anolyte compartment of the cell into the self-draining cathode of the cell, preferably through a multiple layered, liquid electrolyte permeable, microporous polymer film diaphragm at a flow rate about equal to the drainage rate of said cathode. The electrolyte flow rate through said diaphragm is determined by the differential pressure on said diaphragm. On the cathode side of the diaphragm, the pressure may be at atmospheric or elevated pressure as the result of flowing a gas under pressure in admixture with water or an aqueous electrolyte into a cathode bed comprising a packed bed of loose, conductive particles such as graphite. The pressure on the cathode side of the diaphragm can also be less than atmospheric pressure if the gas fed to the cathode is withdrawn at partial vacuum. The pressure on the diaphragm can be adjusted by changing the head of electrolyte in the anolyte compartment. The head of anolyte is specified in this specification and claims as the total head, as measured from the bottom of the diaphragm to the top surface of the anolyte liquid. Thus the effective pressure which causes the flow of anolyte through the cell diaphragm is the head pressure of the anolyte minus the pressure exerted on the bipolar electrode side of said diaphragm by the gas and water or an aqueous liquid electrolyte which is fed into the bipolar electrode of the cell.

The porous, self-draining cathode portion of the bipolar electrode generally has a thickness of about 0.1 to about 2.0 centimeters in the direction of current flow. The cathode preferably comprises a fixed bed (sintered) porous matrix as well as a bed of loose particles, said electrode having pores of sufficient size and number to allow both gas and liquid to flow therethrough. The cathode generally contains particles of a conductive material which may also be a good electrocatalyst for the reaction to be carried out. In the reduction of oxygen to hydrogen peroxide, graphite particles coated with carbon and polytetrafluoroethylene as a binder have been found to be suitable for forming the cathode mass because the graphite substrate is cheap, conductive, and requires no special treatment. For other reactions, uncoated graphite or other forms of carbon or tungsten carbide substrates can be used as well as certain metals such as platinum, iridium, or metal oxides such as lead dioxide or manganese dioxide coated on a conducting or nonconducting substrate. The graphite particles typically have diameters in the range of about 0.005 to about 0.5 centimeters and have a minimum diameter of about 30 to 50 microns. It is the bed of particles which acts as the cathode portion of the bipolar electrode.

Generally, the self-draining cathode is supplied with current through a cathode contacting current distributor which can be a metal mesh or metal sheet, generally made of any electrically conductive metal, but preferably stainless steel or nickel. The current distributor preferably contacts the cathode on the largest face which is opposite to the face which is in contact with the diaphragm which can be liquid permeable or an ion exchange permselective membrane. Where a permselective membrane is used, it is necessary to feed the cathode simultaneously with an aqueous electrolyte in admixture with a reactive gas. Where the diaphragm is liquid permeable, the cathode is simultaneously supplied with electrolyte through the liquid permeable diaphragm and an aqueous liquid, such as water or an electrolyte, together with a depolarizing gas is simultaneously added to the cathode during operation of the cell. By placing the current distributor on an opposite face of the porous, self-draining cathode instead of on the same face which contacts the cell diaphragm, improved flow into the cathode is obtained. In addition, the wicking tendency, shown when the current distributor is on the electrolyte side of the cathode, is avoided.

In the bipolar electrochemical cell embodiment of the invention, each individual cell unit contains a porous, liquid permeable diaphragm separating an anolyte compartment and a catholyte compartment which contain respectively an anode and a cathode of the cell unit. Generally, the cell diaphragm is positioned so as to contact one face of the porous, self-draining cathode.

In one embodiment, the cell separator can be a liquid permeable single layer diaphragm, a liquid permeable diaphragm assembly having multiple layers of a microporous polymer film diaphragm material, or a liquid permeable composite comprising an electrolyte resistant support fabric and a microporous polymer film. The support fabric can be laminated to said film and can be a woven or non-woven fabric selected from the group consisting of asbestos, polyolefins, fluorinated polyolefins, polyamides, polyesters and mixtures thereof. Preferably, said support fabric is derived from a polymer selected from the group consisting of polyethylene, polypropylene, polytetrafluoroethylene, fluorinated ethylene propylene, polychlorotrifluoroethylene, polyvinyl fluoride, polyvinylidene fluoride, and mixtures thereof. For use in the preparation of an alkaline, aqueous solution of hydrogen peroxide, a composite comprising a microporous polyolefin film together with a polypropylene woven or non-woven fabric support layer is preferred. Alternatively, there can be used any other polyolefin, fluorinated polyolefin, polyamide, or polyester support fabric or mixtures thereof and each of these materials can be used in combination with asbestos in the preparation of the supporting fabric. No necessity exists for uniformly holding together the multiple layers of the diaphragm. However, at the peripheral portions thereof or otherwise, the diaphragm layers are held against the frame members of the electrolytic cell. Multiple diaphragm layers of two to about four layers of said microporous film or composite have been found useful in reducing the variation in flow of electrolyte through the cell diaphragm over the usual and practical range of electrolyte head of about 0.5 foot to about 10 feet, preferably about 0.5 foot to about 4 feet. Portions of the multiple layered diaphragm assembly which are exposed to the full head of electrolyte, as compared with portions of the diaphragm assembly which are exposed to little or no electrolyte head, pass substantially the same amount of electrolyte to the cathode.

As an alternative means of producing a useful plural layered liquid permeable diaphragm, it has been found desirable to prepare a cell diaphragm assembly having variable layers of the defined microporous film or composite diaphragm material. Thus it is suitable to utilize one to two layers of the defined porous polymer film or composite material in areas of the diaphragm assembly which are exposed to relatively low pressure as the result of being positioned close to the top surface of the body of electrolyte while utilizing two to six layers of the defined polymer film or composite porous material in areas of the diaphragm assembly exposed to moderate or high pressure of the electrolyte. A preferred construction is two layers of the defined film or composite porous material on the top portion and three layers of said composite on the bottom portion of said diaphragm assembly.

The single layer or plural layered microporous polymer film or single layer or plural layered composite liquid permeable diaphragm is preferably positioned vertically in the electrochemical cell and characterized as hydrophilic, having been treated with a wetting agent in the preparation thereof. In a 1 mil thickness, the film portion of the composite has a porosity of about 38% to about 45%, and an effective pore size of about 0.02 to about 0.04 micrometers. A preferred composite diaphragm consists of a 1 mil thick microporous polyolefin film laminated to a non-woven polypropylene fabric with a total thickness of 5 mils. Such porous material composites are available under the trade designation CELGARD ® from Celanese Corporation. The flow of electrolyte through the diaphragm which may be a single or multiple layer diaphragm, as previously described, is generally about 0.01 to about 5, preferably about 0.03 to about 0.3 and most preferably is about 0.05 to about 0.15 milliliters per minute per square inch of diaphragm. Cells operating at above atmospheric pressure on the cathode side of the diaphragm would have reduced flow rates at the same anolyte head levels since it is the differential pressure that is responsible for electrolyte flow across the diaphragm.

The cell of the invention is generally operated using a total water, other aqueous liquid, or aqueous electrolyte addition to the cathode, in admixture with a reactive gas, of about 0.1 to about 10, preferably about 0.4 to about 3 and most preferably about 1.0 to 2 unit volumes per unit time of cell product produced at the cathode. Where the the reactive gas is an oxygen containing gas, the mole ratio of water to oxygen is generally about 0.1 to about 350, preferably about 1.6 to about 300, and most preferably about 10 to about 50. Preferably the oxygen containing gas is air. Said aqueous liquid is water or an aqueous electrolyte when a liquid permable diaphragm is used but when a permselective membrane cell separator is used, an aqueous electrolyte must be added to the porous, self-draining electrode simultaneously with the reactive gas. The electrolyte can contain an organic or inorganic acid, base, or salt thereof. Representative organic acids are formic acid, acetic acid, and propionic acid. Representative organic bases are aliphatic or aromatic amines such as methylamine, dimethylamine, diethyl amine, n-butylamine, hexamethylenediamine. Representative inorganic acids are hydrochloric acid, sulfuric acid, and phosphoric acid. Representative inorganic bases are sodium hydroxide, potassium hydroxide and ammonium hydroxide. Salts of the above inorganic acids and bases such as sodium sulphate are useful electrolyte components.

The ion exchange permselective membrane cell separator can be a cation-exchange membrane. Cation-exchange permselective membranes are particularly suitable for electrolysis of alkali metal hydroxides to produce an alkaline hydrogen peroxide or the electrolysis of an alkali metal halide brine to produce an alkali metal hydroxide and halogen. Anion-exchange membranes can be used for other processes instead of cation-exchange membranes. Examples of cation-exchange membranes are those formed from organic resins, for instance, phenol-formaldehyde resins or resins obtained by polynerization of styrene and/or divinylbenzene, fluorocarbon resins, polysulphones, or polymethacrylic or phenoxy resins, with cation-exchanging radicals such as $—SO_3H$, $—COOH$, $—PO_2H_2$, $—PO_3H_2$. Such resins also can be employed as mixed polymers or copolymers, for example, fluorocarbon resins can contain substituted or unsubstituted alkoxy groups and contain elements such as sulphur, nitrogen, and oxygen. Generally, resins with sulphonic groups are preferred, and among these polyfluorocarbon resins which contain cation-exchange groups and are copolymers of tetrafluoroethylene with $CF_2{=}CF—OCF_2CF_2SO_3H$, or other corresponding acidic polymerizable fluorocarbon. Preferably, the polyfluorocarbon is at least one of a polymer of perfluorosulphonic acid, a polymer of perfluorocarboxylic acid, and copolymers thereof. These copolymers have equivalent weights of about 900 to about 1800 and are characterized by long fluorocarbon chains with various acidic groups including sulphonic, phosphonic, sulphonamide, or carboxylic groups or alkali metal salts of said groups attached thereto.

Prior art patents U.S. Pat. No. 4,118,305; U.S. Pat. No. 3,969,201; and U.S. Pat. No. 4,445,986 are hereby incorporated by reference. Self-draining, packed bed electrodes disclosed in these patents are typically composed of graphite particles, however other forms of carbon can be used as well as certain metals. The packed bed cathode typical of the prior art has a plurality of interconnecting passageways having average diameteres sufficiently large so as to make the catholes self-draining, that is, the effects of gravity are greater than the effects of capillary pressure on an electrolyte present within the passageways. The diameter actually required depends upon the surface tension, the viscosity, and other physical characteristics of the electrolyte present within the packed bed electrode. Generally the passageways have a minimum diameter of about 30 to about 50 microns, but the maximum diameter is not critical. The self-draining cathode should not be so thick as to unduly increase the resistance losses of the cell. A suitable thickness for a packed bed cathode has been found to be generally about 0.03 inch to about 1 inch, preferably about 0.06 inch to about 0.5 inch. Generally the packed bed cathode is electrically conductive and prepared from such materials as graphite, steel, iron, and nickel. Glass, various plastics, and various ceramics can be used in admixture with conductive materials. The individual particles can be supported by a non-electrically conductive screen or other suitable support or the particles can be sintered or otherwise bonded together but none of these alternatives is necessary for the satisfactory operation of a useful self-draining, packed bed cathode.

An improved material useful in the formation of the self-draining packed bed cathode is disclosed in U.S. Pat. No. 4,457,953, incorporated herein by reference comprising a particulate substrate which is at least partially coated with an admixture of a binder and an electrochemically active, electrically conductive catalyst. Typically the substrate is formed of an electrically conductive or nonconductive material having a particle size smaller than about 0.3 millimeters to 2.5 centimeters or more preferably about 0.25 millimeters to about 2.0 millimeters, and most preferably about 0.30 to about 2 millimeters. The substrate need not be inert to the electrolyte or to the products of the electrolysis process in which the particle is used but is preferably chemically inert since the coating which is applied to the particle substrate need not totally cover the substrate particles for the purposes of rendering the particle useful as a component of a packed bed cathode. Typically the coating on the particle substrate is a mixture of a binder and an electrochemically active, electrically conductive catalyst. Various examples of binder and catalyst are also disclosed in U.S. Pat. No. 4,457,953.

Stabilizing agents suitable for addition to the electrolyte of an electrolytic cell for the production of hydrogen peroxide are disclosed in U.S. Pat. No. 4,431,494, incorporated herein by reference. Such stabilizing agents include compounds that form chelates with impurities found to be catalysts for the decomposition of the hydrogen peroxide produced within the cell. Specific stabilizing agents include alkali metal salts of ethylenediaminetetraacetic acid, stannates, phosphates, alkali metal silicates, and 8-hydroxyquinoline.

In an electrolytic cell where aqueous sodium or potassium hydroxide is desired as a product, generally a brine or potassium chloride is fed to the anolyte compartment of the electrolytic cell so as to maintain a pH of about 1.5 to about 5.5. Typically the sodium or potassium chloride is fed at a saturated or substantially saturated concentration containing from about 300 to about 325 grams per liter of sodium chloride or from about 450 to about 500 grams per liter of potassium chloride. The catholyte liquor recovered from the electrolytic cell can contain approximately 10 to 12 weight percent sodium hydroxide and 15 to 25 weight percent sodium chloride or approximately 15 to 20 weight percent potassium hydroxide and approximately 20 to 30 weight percent potassium chloride.

In the embodiment of the electrolytic cell for the production of hydrogen peroxide, typically the anolyte liquor is an aqueous solution containing about 15 to about 100 grams per liter of alkali metal hydroxide, i.e., sodium hydroxide. The catholyte liquor recovered from a prior art electrolytic cell can contain approximately 0.5 to 8 weight percent hydrogen peroxide and 15 to 200 grams per liter sodium hydroxide. This embodiment of the cell of the invention provides an increased ratio of hydrogen peroxide to sodium hydroxide. The liquor recovered from the cell of the invention contains about 0.5 to 5 weight percent hydrogen peroxide and 10 to 100 grams per liter of sodium hydroxide.

The standard anode material for commercial water electrolyzers has been nickel or stainless steel because of good chemical stability in the normally employed alkaline electrolyte which can have a concentration of alkali metal hydroxide of between 15 and 30% by weight. Over the service life of the nickel electrode, the over-voltage for oxygen evolution increases causing a reduction in efficiency, as indicated by low levels of operational current density. In recent years, increasing attention has been directed toward improving the oxygen over-voltage characteristics of electrolytic cell anodes, particularly those anodes utilized in the electrolysis of water or in the production of hydrogen peroxide where a strongly alkaline anolyte is utilized, for instance, a mixture of an alkali metal halide and an alkali metal hydroxide.

The problem of increased over-potential with increasing service of nickel anodes under alkaline conditions has been lessened by the recent adoption of prior art coatings on electroconductive substrates of noble metals of Group VIII of the Periodic Table of the Elements. However, use of expensive metal coatings such as ruthenium oxide in the production of anodes for oxygen evolution has met with the problem of dissolution of the electrode coating in an alkaline electrolyte. Those metals, which, when coated on electroconductive substrates, do not dissolve in strongly alkaline anolytes during oxygen evolution, will generally be covered with an oxide film and suffer a loss of activity with increasing service. Electrodes having deposited thereon electrode catalysts such as the mixed nickel-molybdenum type of the prior art which subsequent to deposition from a homogeneous solution of their compounds are decomposed to their oxides by heating and thereafter exposed to a reducing atmosphere at elevated temperature, show a marked over-voltage improvement over those disclosed heretofore. Useful electroconductive substrates for use with such electrode catalyst coatings have also been disclosed in the prior art as relatively inexpensive materials such as nickel, iron, copper, titanium, and alloys thereof or of other metallic substances coated with any of these materials.

In an electrolytic cell for the production of chlorine and caustic, the anode of the monopolar electrochemical cell or the anode portion of the bipolar cell of the invention can be a dimensionally stable anode. In an electrolytic cell for the production of hydrogen peroxide, the anode can be stainless steel, nickel, or an insoluble electrode as known in the art.

The frame component of the bipolar cell of the invention can of metal or plastic construction. Prior art cell frame construction has used heavy member construction and/or cylindrical shaped members. Heavy walled construction either with solid, electrolyte resistant metals such as titanium and nickel or steel lined with an electrolyte resistant metal is expensive and consumes large amounts of metal. For these reasons chlor-alkali cells of the filter press type have not been extensively utilized. Generally, filter press type chlor-alkali cells are constructed so that the porous, liquid permeable diaphragms are clamped under pressure between flanges of the filter press frames.

Early filter press type cells were constructed of heavy plastic frames. Generally these cells were of the bipolar type which utilized a solid sheet or back plate which functioned as a divider between the cells and was fabricated integrally with the frame. Bipolar cells of this type followed the well developed filter press fabrication principles. The integral frame-back plate construction provided excellent stiffening of the frame structure. The frames for these cells were molded from hard rubber, filled polypropylene, polyester-fiberglass, polyester or any other material that was chemically resistant to the cell environment. Generally, the anode frame was formed of these plastic materials while the cathode frame was formed from steel.

The size of filter press type cells having plastic frames tends to be limited by the high cost for very large molds and the tendency for warping that tends to occur in heavy plastic frames when the frames are subjected to operating temperatures during actual cell use. The plastic parts employed in these cells tend to have a high coefficient of expansion compared to the electrodes and other metal parts of the cells. Distortion is caused within the cell when the various parts expand or contract at different rates. Filled plastic frames are susceptible to corrosion by chlorine especially when the filler material is a material such as calcium carbonate. Therefore, because of such deficiencies, present day filter press electrolytic cells generally employ metal frames. Metal frame construction provides advantages in high strength, small cross sectional area in the structural members, corrosion resistance, resistance to warping and compatibility with respect to coefficient of expansion with metal electrode surfaces. The very high fabrication cost of metal frames has led to attempts to reduce the cost such as by the employment of plastic frames which will give the advantages that metal frames offer without the high cost.

A typical frame component of the bipolar cell embodiment of the invention can be composed of solid, as opposed to hollow or U or channel shaped frame member of metal or plastic which are resistant to exposure to chemicals with which the frame members come into contact under operating conditions of the bipolar electrolytic cell. The frame components of the bipolar electrolytic cell can also be formed of U or channel shaped members suitably formed so as to accommodate insertion of a reinforcing core material within the opening in the frame members.

The following examples illustrate the various aspects of the invention but are not intended to limit its scope. Where not otherwise specified throughout this specification and claims, temperatures are given in degrees centigrade and parts, percentages, and proportions are by weight.

EXAMPLE 1

An electrolytic cell was constructed in accordance with the schematic diagram shown in FIG. 1. The cell was a single cell unit having a body of polymethylmethacrylate and an anode of 304 stainless steel sheet. The current collector portion of the cathode which was positioned on the side of the porous, self-draining portion of the cathode bed opposite to that which is in contact with the cell diaphragm was of nickel 200. The cell diaphragm was composed of three layers of a 1 mil thick microporous polyolefin film laminated to a nonwoven polypropylene fabric so as to provide a total laminated thickness of 5 mils in each layer of the composite thus, a total cell diaphragm cell thickness of 15 mils resulted by the use of three layers of this composite material which is sold under the trademark CELGARD® 5511. The porous, self-draining portion of the cathode bed of the invention was composed of chips made in accordance with the method described in U.S. Pat. No. 4,457,953. The cathode was fed with a mixture of water and oxygen so that the proportion of oxygen tot he total oxygen-water mixture was 0.99. The cell active area measured 27 inches by 2 inches and the hydraulic head of anolyte was about 29 inches. At a current density of about 0.38 ASI, the output parameters of the cell were measured utilizing a constant flow of water to the cathode of about 3 cubic centimeters per minute. The results were as follows: cell voltage 1.96 volts, current efficiency 91%, concentration of hydrogen peroxide produced at cathode, 35 grams per liter. The ratio of sodium hydroxide to hydrogen peroxide in the aqueous alkaline hydrogen peroxide product produced in the cell was 1.65. The flow of oxygen to the cathode was 297 cubic centimeters per minute. The total aqueous liquid flow to the cathode, including electrolyte flowed through the cell diaphragm and water added with the oxygen, was 5.5 cubic centimenters per minute.

EXAMPLE 2

(Control Forming No Part of this Invention)

A similar electrolytic cell, as compared to that described in Example 1 was set up and run to evaluate the output parameters of the cell where no additional water is added to the cathode together with oxygen. Under otherwise similar operating conditions as described of the cell of Example 1, the following output parameters were obtained: voltage 1.99, current efficiency 79%, hydrogen peroxide concentration 47 grams per liter, ratio of sodium hydroxide to hydrogen peroxide 1.68, and total flow of electrolyte through the cell diaphragm 3.5 cubic centimeters per minute.

EXAMPLE 3

Example 1 is repeated substituting a cation exchange permselective membrane cell separator for the electrolyte permeable cell diaphragm used in Example 1. Similar results are obtained as in Example 1 when an electrolyte is added together with oxygen to the cathode bed.

EXAMPLE 4

Example 1 is repeated substituting for the cell diaphragm in Example 1 a microporous polytetrafluoroethylene film sold under the trademark ZITEX®. Similar results are obtained for cell voltage, current efficiency, and concentration of hydrogen peroxide produced at the cathode.

While this invention has been described with reference to certain specific embodiments, it will be recognized by those skilled in the art that many variations are possible without departing from the scope and spirit of the invention and it will be understood that it is intended to cover all changes and modifications of the invention shown wherein for the purposes of illustration which do not constitute departures from the spirit and scope of the invention.

The embodiments of the invention in which an exclusive property or privilege is claimed are defined as follows:

1. In an electrochemical cell for the reaction of a liquid electrolyte with a reactive gas, said cell having electrodes comprising at least one anode and one cathode contained respectively in at least one anolyte compartment and at least one catholyte compartment separated by a cell separator, at least one of said electrodes characterized as porous and self-draining; the improvement whereby the current efficiency of said cell is increased by providing means for simultaneously flowing into said porous and self-draining electrode said electrolyte through said cell separator and (A) said reactive gas in admixture with an aqueous liquid or (B) said reactive gas in admixture with an aqueous electrolyte.

2. The cell of claim 1 wherein said aqueous liquid is flowed by said means to a cathode in the proportion of about 0.1 to about 10 unit volumes per unit time per unit volume per unit time of cell product produced at said cathode, said cell product is hydrogen peroxide or an alkali metal hydroxide, and said reactive gas is an oxygen containing gas.

3. The cell of claim 2 wherein said cell separator comprises an electrolyte permeable single layer or an electrolyte permeable plurality of layers of a microporous polymer film or an electrolyte permeable composite comprising a plurality of layers of a composite consisting of said microporous polymer film and a support fabric resistant to deterioration upon exposure to an aqueous solution of an ionizable compound and electrolysis products thereof.

4. The cell of claim 3 wherein said aqueous liquid is water or an electrolyte.

5. The cell of claim 4 wherein said cell is a bipolar electrode, filter press type electrolytic cell, said cell comprising an electrode assembly comprising a porous, packed bed, self-draining cathode and a current distributor and said ionizable compound is an alkali metal halide or an alkali metal hydroxide.

6. The cell of claim 4 wherein said polymer film separator is a microporous polyolefin film having a porosity of about 38% to about 45%, an effective pore size of about 0.02 to about 0.04 micrometers, and a thickness of about 1 mil which is positioned vertically in said electrolysis cell.

7. The cell of claim 4 wherein said electrolyte permeable composite comprises two to about four layers having an electrolyte flow rate of about 0.01 to about 0.5 milliliters per minute per square inch of separator over an electrolyte head of about 0.5 foot to about 10 feet.

8. The cell of claim 7 wherein said support fabric portion of said composite is a woven or non-woven fabric selected from the group consisting of asbestos, polyolefins, fluorinated polyolefins, polyamides, polyesters, and mixtures thereof.

9. The cell of claim 8 wherein said support fabric portion of said composite is selected from the group consisting of polyethylene, polypropylene, polytetrafluoroethylene, fluorinated ethylenepropylene, polychlorotrifluoroethylene, polyvinyl fluoride, polyvinylidene fluoride, and mixtures thereof.

10. The cell of claim 9 wherein said composite has variable layers consisting of a combination of one to two layers of said composite at the top of said separator and two to six layers of said composite at the bottom of said separator and said support fabric is selected from the group consisting of polytetrafluoroethylene, fluorinated ethylenepropylene, polychlorotrifluoroethylene, polyvinyl fluoride, polyvinylidene fluoride, and mixtures thereof.

11. The cell of claim 1 wherein said cell separator is an ion exchange permselective membrane, said aqueous liquid is an aqueous electrolyte which is flowed to a cathode in the proportion of about 0.1 to about 10 unit volumes per unit time per unit volume per unit time of cell product produced at said cathode, said cell product is hydrogen peroxide or an alkali metal hydroxide, and said reactive gas is an oxygen containing gas.

12. The cell of claim 11 wherein said cell is a bipolar electrode, filter press type electrolytic cell, said cell comprising an electrode assembly comprising a porous, packed bed, self-draining cathode and a current distributor and said liquid electrolyte comprises an alkali metal halide or an alkali metal hydroxide.

13. In a process for reacting a liquid electrolyte with a reactive gas in an electrochemical cell, said cell having electrodes comprising at least one anode and one cathode contained respectively in at least one anolyte compartment and at least one catholyte compartment separated by a cell separator; at least one of said electrodes characterized as porous and self-draining, the improvement comprising electrolyzing said liquid electrolyte with increased current efficiency by simultaneously flowing into said porous and self-draining electrode (1) said electrolyte through said cell separator and (2) said reactive gas in admixture with an aqueous liquid.

14. The process of claim 13 wherein said electrochemical cell is adapted for the electrolysis of an alkali metal halide or an alkali metal hydroxide and said anode and cathode are separated by a cell separator comprising a plurality of layers of a microporous polymer film or a plurality of layers of a composite comprising said microporous polymer film and a support fabric resistant to deterioration upon exposure to an aqueous solution of an ionizable compound and electrolysis products thereof.

15. The process of claim 14 wherein said aqueous liquid is flowed into a cathode in the proportion of about 0.1 to about 10 unit volumes per unit time per unit volume per unit time of product produced at said cathode.

16. The process of claim 15 wherein said aqueous liquid is water or an electrolyte.

17. The process of claim 16 wherein said reactive gas is an oxygen containing gas.

18. The process of claim 15 wherein said aqueous liquid is water and said electrochemical cell is a bipolar, filter press type electrolytic cell adapted to produce chlorine and caustic or an alkaline, aqueous hydrogen peroxide.

19. In a process for reacting a liquid electrolyte with a reactive gas in an electrochemical cell, said cell having electrodes comprising at least one anode and one cathode contained respectively in at least one anolyte compartment and at at least one catholyte compartment separated by an ion exchange permselective membrane cell separator; at least one of said electrodes characterized as porous and self-draining, the improvement comprising electrolyzing said liquid electrolyte with increased current efficiency by simultaneously feeding said porous and self-draining electrode with said reactive gas in admixture with an aqueous electrolyte.

20. The process of claim 19 wherein said aqueous electrolyte is flowed into a porous and self-draining cathode in the proportion of about 0.1 to about 10 unit volumes per unit time per unit volume of product produced at said cathode, said cell is adapted to produce at said cathode hydrogen peroxide or an alkali metal hydroxide, and said reactive gas is an oxygen containing gas.

21. The process of claim 20 wherein said electrochemical cell is a bipolar, filter press type electrolytic cell adapted to produce chlorine and caustic or an alkaline, aqueous hydrogen peroxide.

* * * * *